US006164416A

United States Patent [19]

Laine et al.

[11] Patent Number: 6,164,416

[45] Date of Patent: Dec. 26, 2000

[54] PROCEDURE AND APPARATUS FOR THE DECELERATION OF AN ELEVATOR

[75] Inventors: Antti Laine, Hong Kong, The Hong Kong Special Administrative Region of the People's Republic of China; Arvo Pakarinen, Hyvinkää, Finland; Tapio Saarikoski, Hyvinkää, Finland; Jan Tull, Hyvinkää, Finland

[73] Assignee: Kone Corporation, Finland

[21] Appl. No.: 09/171,975

[22] PCT Filed: Apr. 30, 1997

[86] PCT No.: PCT/FI97/00265

§ 371 Date: Oct. 29, 1998

§ 102(e) Date: Oct. 29, 1998

[87] PCT Pub. No.: WO97/41055

PCT Pub. Date: Nov. 6, 1997

[30] Foreign Application Priority Data

Apr. 30, 1996 [FI] Finland ..... 961828

[51] Int. Cl.[7] ..... B66B 1/42

[52] U.S. Cl. ..... 187/284; 187/291

[58] Field of Search ..... 187/247, 224, 187/291, 292; 318/362, 365, 366, 369

[56] References Cited

U.S. PATENT DOCUMENTS 4,081,058 3/1978 Duriez et al. .
4,128,142 12/1978 Satoh et al. .
4,319,665 3/1982 Komuro et al. .
4,501,344 2/1985 Uherek et al. ..... 187/29 R
4,518,062 5/1985 Markinen et al. .
4,570,755 2/1986 Tsai et al. ..... 187/29 R
4,751,984 6/1988 Williams et al. ..... 187/116
5,035,301 7/1991 Skalski ..... 187/118
5,266,757 11/1993 Krapek et al. ..... 187/116
5,637,841 6/1997 Dugan et al. ..... 187/294

*Primary Examiner*—Jonathan Salata
*Attorney, Agent, or Firm*—Birch, Stewart, Kolasch & Birch, LLP

[57] ABSTRACT

To decelerate an elevator to a floor, the position of the elevator is determined and this data is used to calculate a required deceleration value with which the speed and deceleration of the elevator are reduced to zero upon reaching the floor and the deceleration changes by the amount of a constant jerk during the final round-off. A deceleration reference value is repeatedly compared with the required deceleration value determined on the basis of the position data, and the deceleration reference value is changed towards the required deceleration value based on the position data. During deceleration, the system is monitored to establish the point of time when the conditions for starting the final round-off are valid, and the final round-off is started accordingly. After the starting point of the final round-off, a speed reference value is determined using a jerk that fulfills the carting conditions.

12 Claims, 5 Drawing Sheets

PROCEDURE AND APPARATUS FOR THE DECELERATION OF AN ELEVATOR

This application is the national phase under 35 U.S.C. §371 of prior PCT International Application No. PCT/FI97/00265 which has an International filing date of Apr. 30, 1997 which designated the United States of America, the entire contents of which are hereby incorporated by reference.

BACKGROUND OF THE INVENTION

1. Field of the Invention

The present invention relates to a procedure and to an apparatus for the deceleration of an elevator.

2. Description of the Related Art

According to various elevator regulations, an elevator must be able to stop at a landing with a certain accuracy. The required tolerance is typically of the order of ±5 mm, which is easily attained by modern elevators. However, a greater stopping precision is aimed at, because the stopping accuracy is also regarded as a measure of quality of the elevator. Moreover, the co-operation between certain parts of the elevator equipment, such as the car door and the landing door, is better in an elevator capable of accurate stopping.

The determination of elevator position is implemented using pulse tachometers mounted in conjunction with the machinery and giving pulse counts that are directly proportional to the revolutions performed by the machine. Another device used for the determination of elevator position is a tachometer which produces an analog voltage proportional to the elevator speed and whose output voltage is converted into a pulse train in which the pulse frequency is proportional to the speed and the pulse count to the distance covered by the elevator. However, in both tachometer types, the distance calculated from the pulse count is not quite accurate because the elevator is driven by means of the friction between the elevator ropes and the traction sheave. The distance calculated from the tachometer pulses contains a small error, because there occurs a slight movement of the elevator ropes relative to the traction sheave. Although the error in the calculated distance is not large, usually only a few millimeters, an objective in modern elevator technology is to eliminate even this small error.

Various solutions have been proposed to solve this problem, e.g. by updating the pulse counts representing elevator position at each floor, as is done in U.S. Pat. No. 4,493,399. In some elevators two tachometers, an analog tachometer and a pulse tachometer, are used, together or separately. Another solution used to indicate elevator position is to provide the shaft or car with code reading devices producing accurate position data.

The behavior of an elevator is also controlled by factors relating to passenger comfort, such as e.g. acceleration, deceleration and changes in them, which, though in fact irrelevant to the problem of determining elevator position, impose certain edge conditions regarding elevator control.

SUMMARY OF THE INVENTION

The object of the present invention is to integrate the acceleration and deceleration of an elevator and their changes as well as the calculation of elevator position with the elevator control so as to achieve a good stopping accuracy and a desired level of travelling comfort when the elevator is being stopped at a floor.

When the procedure of the invention is applied, the elevator will have maximal performance characteristics, such as a high stopping accuracy and a comfortable travelling behavior within the framework of given performance parameters, such as acceleration, deceleration and the change in acceleration and deceleration (jerk). The procedure of the invention obviates the need to carry out adjustments of deceleration elements during installation.

According to the solution presented, the required deceleration is determined continuously on the basis of the remaining distance and the elevator is accordingly brought smoothly to the landing. The deceleration is changed continuously towards a point at which, using a calculated jerk, the speed, deceleration and remaining distance become zero.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
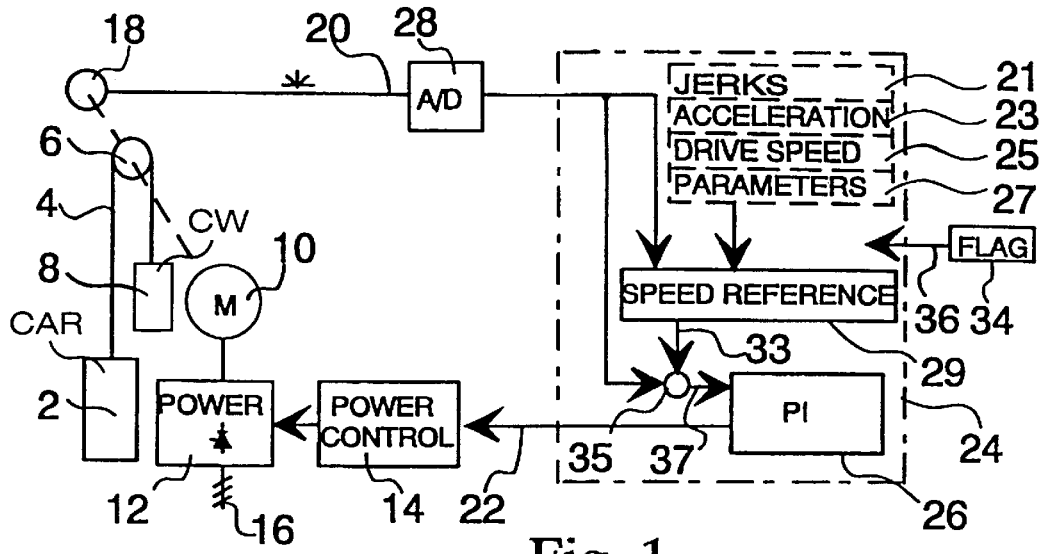
FIG. 1 presents an elevator environment according to the invention.

The elevator car 2 (FIG. 1) is suspended on a hoisting rope 4 which is passed around the traction sheave 6, with a counter-weight (cw)8 attached to the other end of the rope. To move the elevator, the traction sheave 6 is rotated by means of an elevator motor 10 coupled to its shaft and controlled by a control gear 12. The control gear 12 comprises a frequency converter which, in accordance with control signals obtained from a control unit 14, converts the electricity supplied from a network 16 into the voltage and frequency required for the elevator drive. The control unit 14 sends the control pulses to the solid state switches of the frequency converter. The control unit 14 receives a frequency and amplitude reference via conductor 22 from the regulating and calculating unit 24 of the elevator or, more specifically, from a controller 26. To generate speed feedback, a tacho-generator 18 is connected to the traction sheave shaft either directly or via a belt to produce a tacho-voltage proportional to the speed of rotation.

The tacho-voltage proportional to the speed of the elevator motor is passed via conductor 20 to an analog/digital converter 28, which gives the motor speed as a digital quantity consistent with the SI system, which is fed into the regulating and calculating unit 24 of the elevator. Stored in this unit 24 are nominal values, selected for the elevator drive, for the jerks 21, acceleration 23, drive speed 25 during the constant-velocity stage and other parameters 27, such as coefficients determining the margin by which the acceleration or jerk may be higher or lower than its nominal value. From a flag 34 mounted in the elevator shaft, the system obtains data indicating the elevator position in the vicinity of a landing, and this data is taken via conductor 36 to the regulating and calculating unit 24. In a manner to be described later on, a speed reference unit 29 calculates from the above-mentioned quantities a speed reference for the elevator at different phases of the movement of the elevator car so that, after leaving a landing, the elevator car is optimally accelerated to the highest possible drive speed and especially stopped smoothly exactly at the target floor. The distance from the floor as required for the calculation is defined as a time integral of the speed signal. The speed reference 33 obtained from unit 29 together with the speed signal is fed into a discriminating element 35 and the output 37 of the discriminating element is fed into the controller 26, known itself, which contains a PI controller and produces the frequency and amplitude reference for the control unit 14. In a preferred embodiment of the invention, the control is implemented as a software based solution, but the invention can also be implemented using components performing the corresponding functions.

Figure 2:
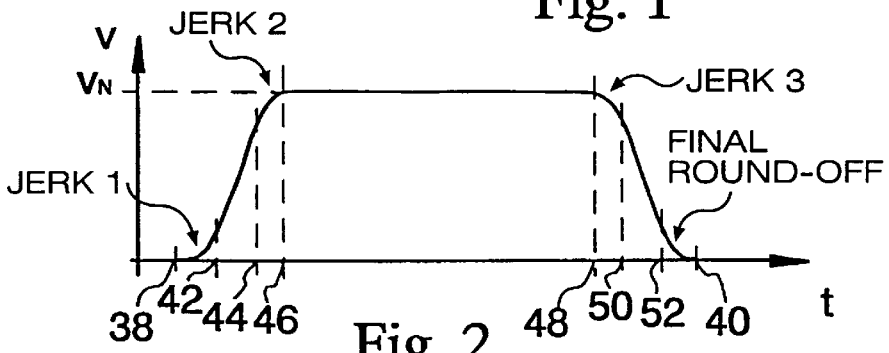
FIG. 2 represents correct operation of an elevator when reaching a target floor.

At point 48, when the elevator car reaches the deceleration point of the target floor, reduction of the speed reference is started, first at the jerk3 stage with a changing deceleration using a nominal jerk up to point 50, then with constant deceleration to point 52 and finally with a changing deceleration during the final round-off to point 40. If deceleration is started from the nominal speed using nominal deceleration and a nominal jerk, the deceleration point must be exactly right to enable the elevator to stop exactly at the floor level of the target floor. In this case the drive speed curve corresponds to the drive speed curve for acceleration described above. FIG. 2 represents a case like this. In the situation represented by FIG. 3, the deceleration point 48' has been calculated as being located at a longer distance from the floor level than it actually is. With nominal jerks and nominal deceleration, the elevator stops before the floor level at point 40' while the speed is changed as indicated by the broken line 54. Correspondingly, in the case illustrated by FIG. 4, the deceleration point has been calculated as being located at point 48" and consequently the elevator speed is decelerated as indicated by curve 56 and the elevator stops at point 40".

Figure 3:
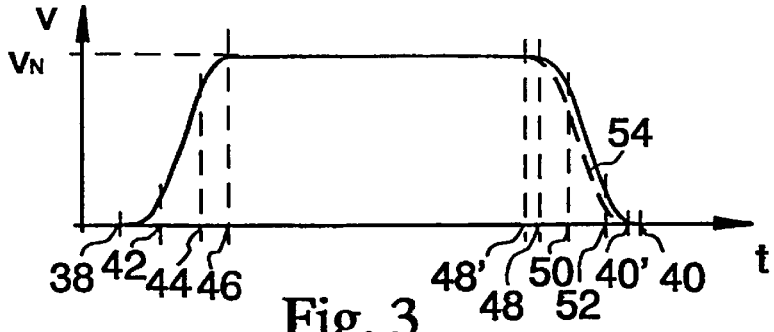
FIG. 3 represents a case of premature stopping.
Figure 4:
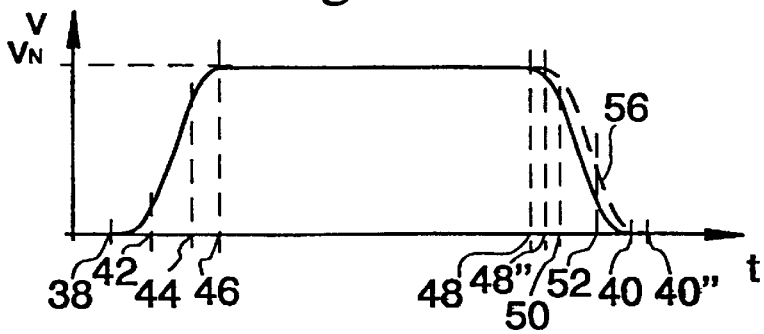
FIG. 4 represents a case of belated stopping.

If the driving distance is so short that the nominal speed cannot be reached, then a transition is made from the constant acceleration phase in FIGS. 2, 3 and 4 via a change of acceleration directly to the constant deceleration phase. The durations of the constant acceleration and deceleration phases and, correspondingly, the maximum drive speed change in accordance with the driving distance. This has no effect on the deceleration procedure, which will be described later on, but the system functions in the same way even in this situation after the onset of constant deceleration.

Figure 5:
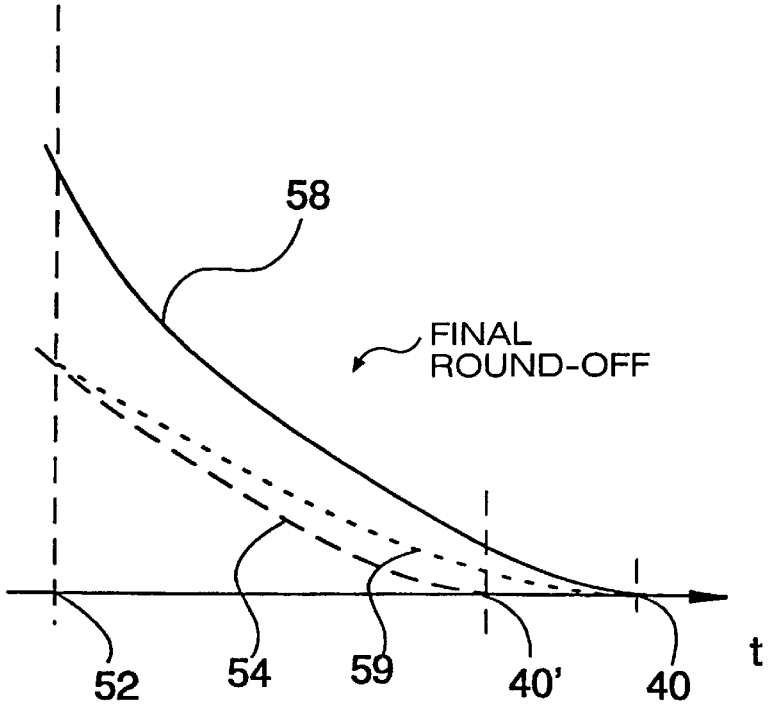
FIG. 5 represents correction of premature stopping.

FIG. 5 shows the deceleration phase of the situation represented by FIG. 3 in a magnified view in order that the control procedure of the invention can be described more explicitly. The deceleration as provided by the invention as well as the speed reference and the final round-off or rate of change of deceleration before stopping are determined in the manner illustrated by the block diagrams in FIGS. 7, 8 and 9. The calculation procedure is performed by the speed reference calculating unit and the speed reference obtained as a result is fed into the control unit 14. The elevator now decelerates at an optimal rate and so that, at the instant of stopping, the elevator is at the level of the target floor and its speed and deceleration are zero. Thus, the elevator reaches the target floor as quickly as possible from the deceleration point to the floor level and the deceleration occurs smoothly without any abrupt changes in speed or deceleration.

At the start of the deceleration phase, the speed reference is altered by the amount of the nominal jerk, and the deceleration and speed are calculated according to the following equations $$a_{de}=J\cdot t_r$$

$$a_{di}=\frac{v_{ref}^2}{2\cdot(d-dx)}$$

$$v_{ref}=v_n-\frac{J\cdot t_r^2}{2}, \text{ where}$$

$t_r$ is the rounding time of the speed curve starting from the deceleration point with differential steps dt starting from the value dt, $a_{de}$ is the deceleration reference, which is changed by the amount of the nominal jerk, J is the nominal jerk, which has been selected as a default value for acceleration changes at start and at the end of constant acceleration, jerk1, jerk2 and jerk3, $a_{di}$ is a deceleration value as calculated from the remaining distance to the floor level, d is the distance to the floor level of the target floor, $d_x$ is the travel distance required for the final round-off, i.e. the additional distance to be traveled because of the final round-off in addition to the distance that would be traveled if the elevator were decelerated with constant deceleration to the target floor. $d_x$ is calculated using a pre-selected jerk value (=nominal jerk).

The deceleration quantities $a_{de}$ and $a_{di}$ are calculated and their values are compared with each other. The transition to constant deceleration is subject to the following requirement: $a_{de}\geqq a_{di}$.

If this condition for a transition to constant deceleration is not fulfilled, a new speed reference for the changing deceleration phase will be calculated at the next instant following the previous calculation after the lapse of the differential step dt.

Figure 6:
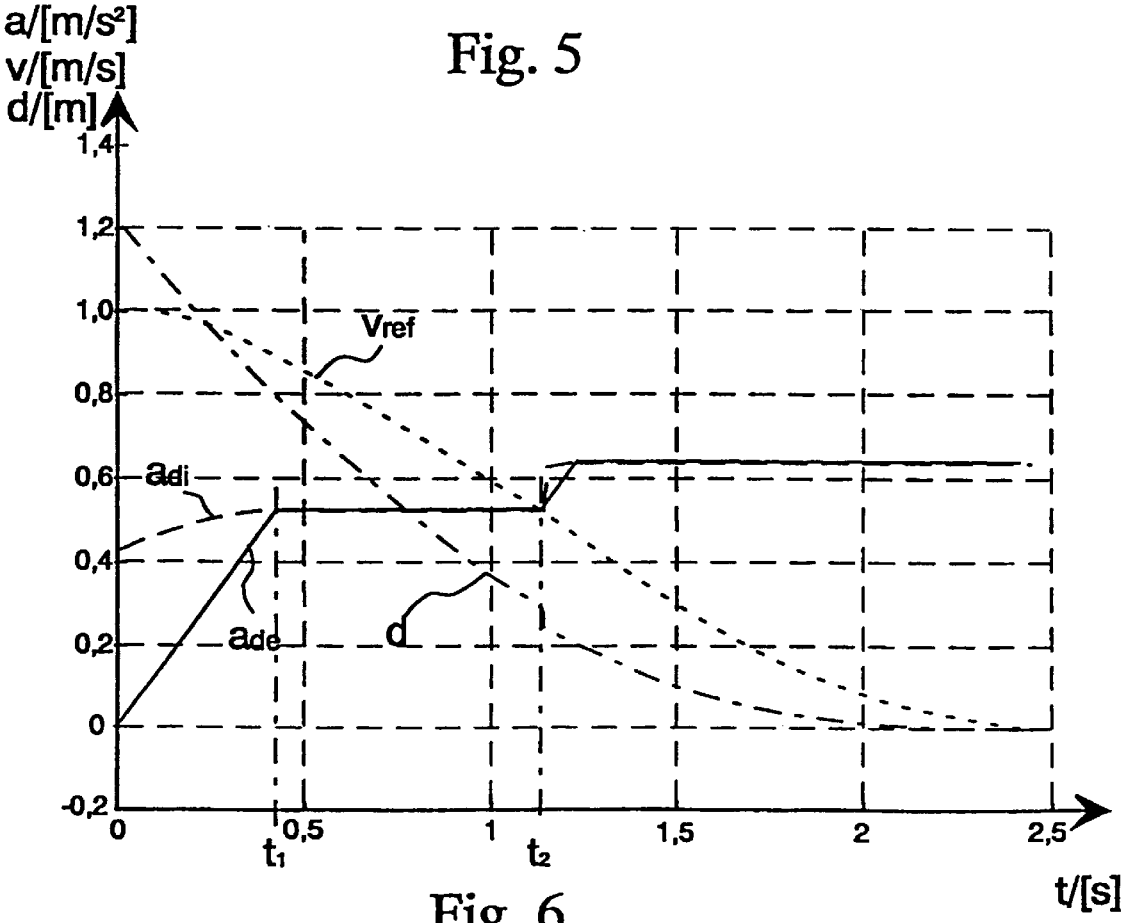
FIG. 6 illustrates the interconnections between deceleration, velocity and position in the solution of the invention.
Figure 7:
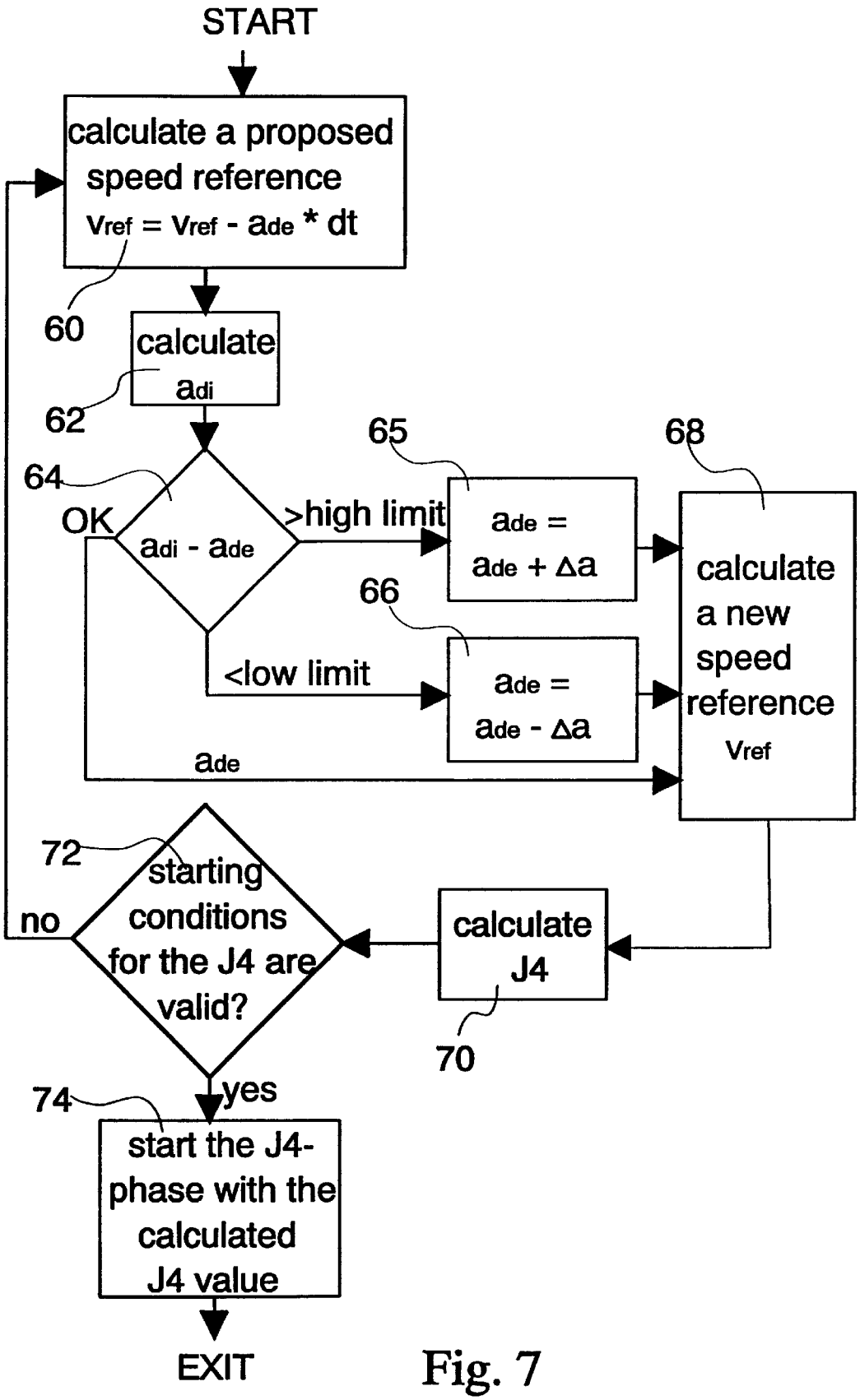
FIG. 7 presents a block diagram of the deceleration phase of an elevator.

During the constant deceleration phase, the speed reference 33 is reduced in accordance with the block diagram in FIG. 7. According to the invention, during the constant deceleration phase the system is trying to find a point where the final deceleration can be started with the allowed jerk, i.e. where the transition to the final round-off on the speed reference curve is to occur. When this point (corresponding to point 52 in FIGS. 2–5) is found, the deceleration is changed from then on by a constant jerk and the acceleration and speed references are changed accordingly, with the result that the acceleration, speed and distance from the target floor reach zero value at the same instant. FIG. 6 shows how the speed reference $v_{ref}$ (33 in FIG. 1), the distance d and the deceleration reference $a_{di}$, calculated using the distance and the nominal jerk, and correspondingly $a_{de}$. change as functions of time. In block 60, a proposed future value of the speed reference is calculated by reducing the value of the speed reference by the amount of $a_{de}$*dt. Based on the remaining distance, a new $a_{di}$ value (block 62) is calculated according to a formula to be presented later on in connection with FIG. 8. If the difference between the deceleration reference ade and the deceleration $a_{di}$ calculated on the basis of the distance exceeds the allowed deceleration deviation $\Delta a=J*dt$, the deceleration $a_{de}$ will be corrected by $\Delta a$ (blocks 64, 65). Correspondingly, the deceleration is corrected by $\Delta a$ if the above-mentioned difference is smaller than $-\Delta a$ (blocks 64 and 66) or, if the difference is smaller, the current deceleration $a_{de}$ is maintained. In this way, the speed reference is made to follow the deceleration, which has been calculated on the basis of the remaining distance to the floor level, or if the deviation exceeds $\Delta a$, the deceleration reference can be made to approach the deceleration calculated on the basis of the distance in steps of $\Delta a$, so the change will take place without any large jerks. FIG. 6 shows the change in $a_{di}$ and $a_{de}$ at the beginning of deceleration towards their point of coincidence at instant $t_1$, which is when the constant deceleration phase begins. For example, when position correction (vane edge, flag) occurs during deceleration, the sudden change in the position data changes the deceleration reference, by means of which it is possible to produce a smooth round-off in the speed curve. The deceleration reference $a_{de}$ is now changed in steps towards the deceleration reference $a_{di}$ calculated on the basis of distance until they are equal. The changes in the distance, deceleration and speed reference can be observed at point $t_2$ in FIG. 6, at which a stepwise distance correction is made. The deceleration $a_{di}$ calculated on the basis of the distance changes in a stepwise manner (broken line), while the deceleration reference or the deceleration $a_{de}$ (solid line) corresponding to the speed reference changes more slowly. In the curve of the speed reference $v_{ref}$, the change is visible as an almost imperceptible change in the slope. In block 68, based on the new deceleration reference, a new speed reference $v_{ref}$ is calculated, whereupon the value of the change J4 of deceleration for the final round-off is calculated (block 70), which is presented in greater detail in FIG. 9. If the condition for starting the final round-off exists (block 72), the final round-off phase will be activated. If not, action will be restarted from block 60 and a new speed reference will be calculated.

Figure 8:
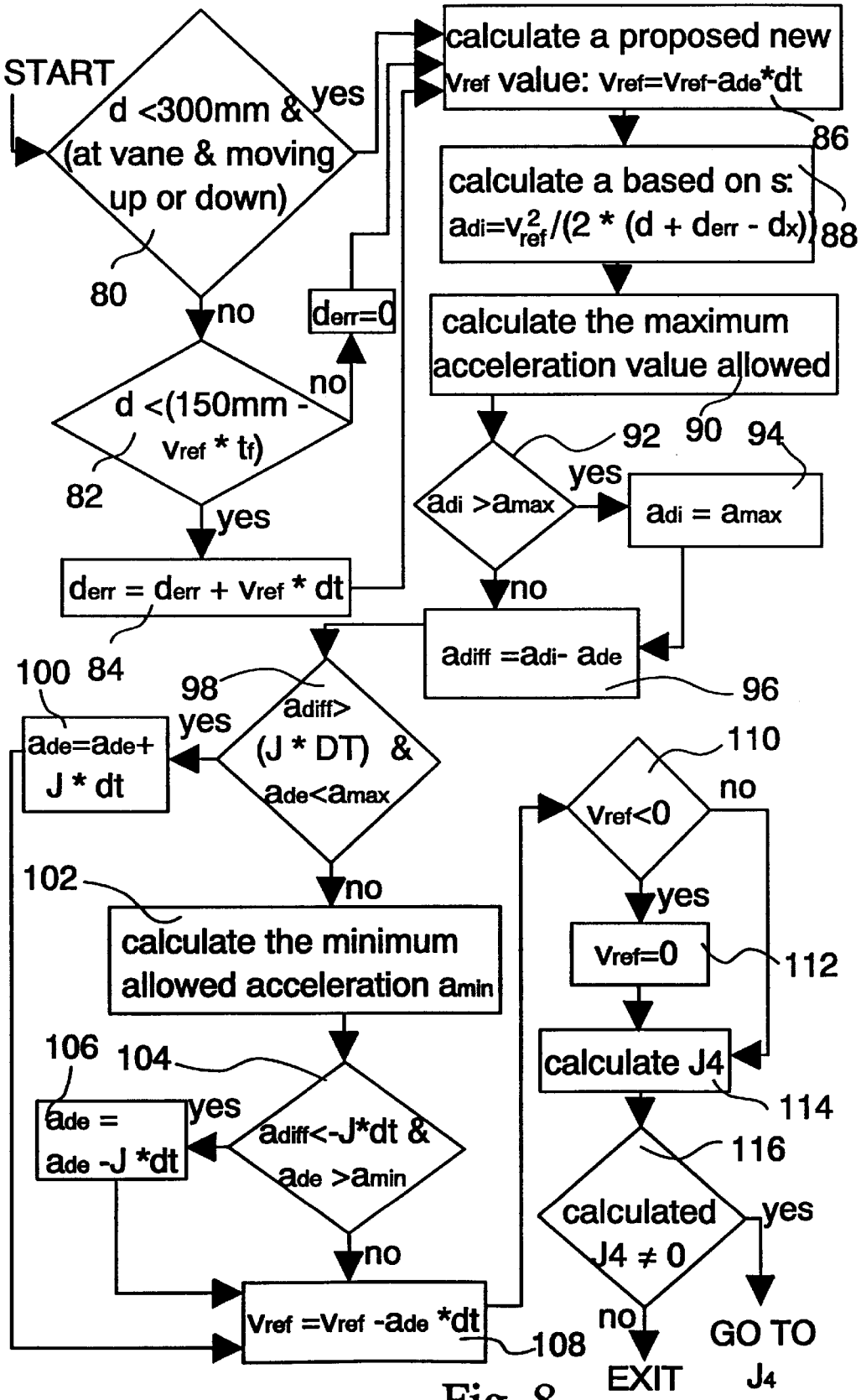
FIG. 8 represents the process of defining a reference value during the deceleration phase.
Figure 9:
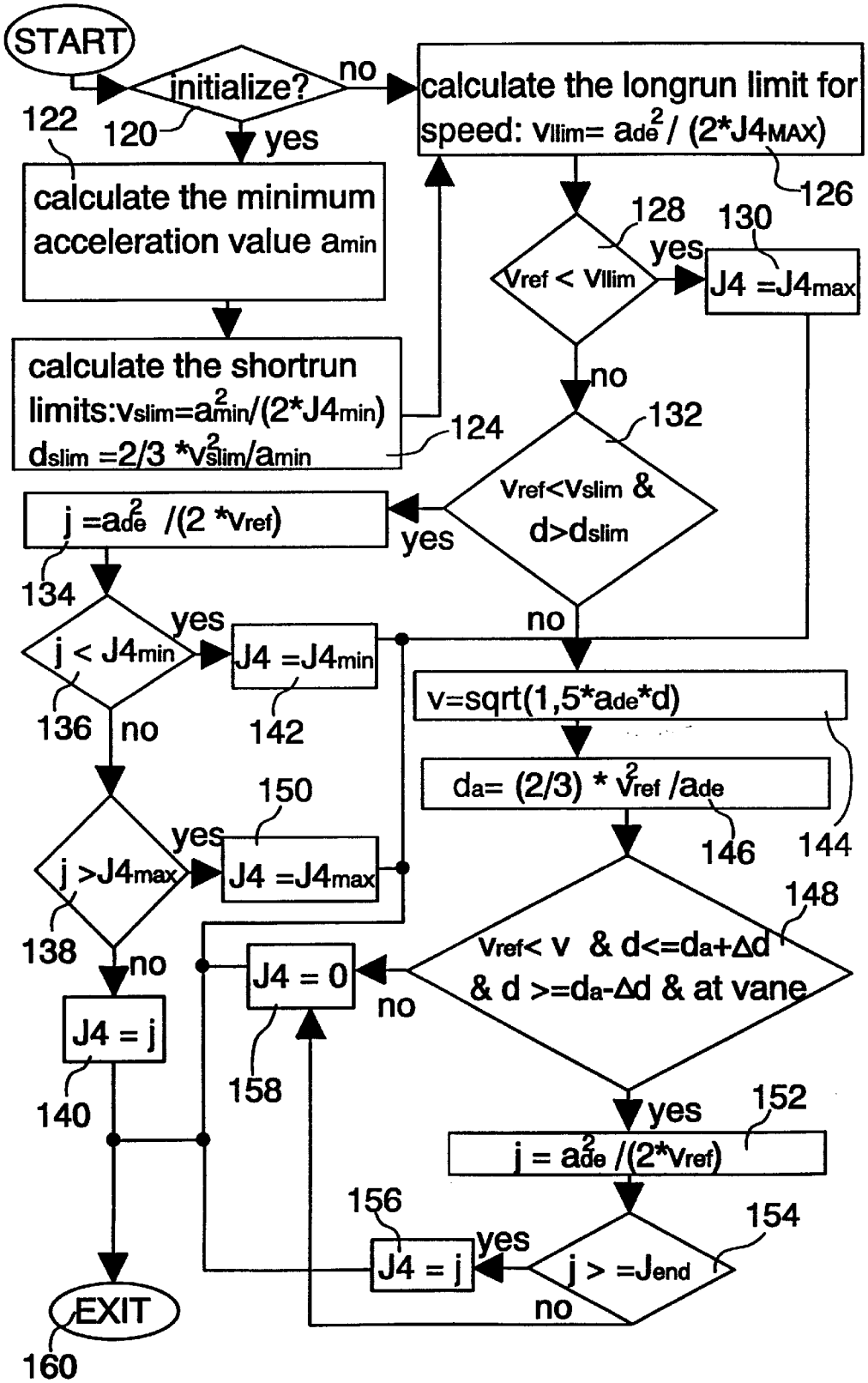
FIG. 9 represents the process of defining the change of deceleration during the final round-off.

The procedure depicted in FIG. 8 is used to determine the speed reference during deceleration. In selection block 80 a check is made to see if the elevator is close to the floor level and if the flag has been detected. If there is no flag data and the distance calculation indicates that the elevator is at a distance below 150 mm from the floor (block 82), then an estimate $d_{err}$ of position or distance error is generated, to be used in the deceleration value $a_{di}$ (block 88) calculated on the basis of distance. The position error $d_{err}$ is increased by the step $v_{ref}*dt$ (block 84) and this correction is made on each calculation cycle when the position counter indicates that the flag should have been reached but the flag has not been detected. In this way, the position data is corrected in advance towards the probable absolute position. Using the speed reference and the deceleration reference, a proposed new speed reference $v=v_{ref}-a_{de}*dt$ (block 86) is calculated. Based on an ascertained or corrected-estimate, the deceleration is calculated, using the distance to the target floor, as $a_{di}=v^2/(2*(d+d_{err}-d_x))$, where $d_x$ is the distance required for the final round-off when the nominal jerk value is used (block 88). The maximum allowed deceleration value $a_{max}$, for which a suitable value is $k_1$*nominal deceleration (for instance, $k_1=1.3$), is calculated (block 90), whereupon in block 92 a check is performed to see if the deceleration value adi calculated on the basis of distance exceeds the maximum deceleration value, to which the deceleration is limited (block 94) if the maximum deceleration is exceeded. If the difference $a_{diff}$ (block 96) between the adi based on distance and the deceleration reference ade is larger than the reference value (=J*dt, where J is the default jerk value) and the deceleration reference is below the maximum, then the deceleration reference will be increased by the value J*dt (blocks 98 and 100). If the condition applied in block 98 is not valid, then a check is made (block 104) to see if the deceleration reference is above the minimum allowed deceleration reference $a_{min}=k_2$*nominal acceleration (preferably $k_2=0.7$) (block 102) and if the difference $a_{diff}$ between the $a_{di}$ calculated on the basis of distance and the deceleration reference $a_{de}$ is less than the reference value (=−J*dt), and in a positive case the deceleration reference ade is reduced by the amount of J*dt. Using deceleration references corrected in blocks 100 or 106 or, if no changes are allowed, an unchanged deceleration reference, a new speed reference value $v_{ref}=v_{ref}-a_{de}*dt$ is calculated (block 108). Finally the speed reference is checked to ensure that it is not below zero (blocks 110 and 112) and a jerk value J4 for the final round-off is calculated (block 114). If the jerk has a non-zero value, the final round-off will be started using the calculated jerk value, producing a speed curve with a final round-off determined by the selected jerk. If the jerk is zero, the procedure will continue with a repeated speed reference calculation.

For the calculation of the jerk J4 for the final round-off in the manner provided by the invention, there are two edge conditions, one for a case where the elevator is going to stop at a level past the floor and the other for a case where the elevator is stopping at a level before the floor. In addition, there are conditions for calculating the jerk in a normal case. If the initial data have not been defined (block 120), then a minimum deceleration $a_{min}$, a speed limit $v_{slim}$ and a distance limit $d_{slim}$ (124) are calculated for situations where the elevator is stopping before the level of the floor. A speed reference limit $v_{llim}$ for situations where the deceleration reference would let the elevator advance past the floor level is calculated in block 126. If the speed reference is below the limit thus calculated, the jerk will be assigned a maximum value $J4=J4_{max}$ (blocks 128 and 130) and the procedure will continue with a renewed speed reference calculation (FIG. 8). The maximum value of the jerk, as well as its minimum value mentioned below, have been defined as parameters for the elevator drive. If the speed reference is below the shortrun limit and the distance is above the shortrun limit (block 132), this means that it is no longer possible to reach the floor level. In this case, the jerk value is calculated from the speed reference (block 134) and checked to ensure that it is not below the allowed minimum value $J4_{min}$ or above the allowed maximum value $J4_{max}$, and the jerk is assigned the value thus calculated, i.e. $J4=j=a_{de}^2/(2*v_{ref})$ (blocks 136, 138 and 140). If the calculated jerk is below the minimum value, the jerk will be assigned the minimum value $J4=J4_{min}$ (block 142), or if the calculated jerk is above the maximum value, the jerk will be assigned the maximum value $J4=J4_{max}$ (block 150).

When the elevator is stopping with normal deceleration, i.e. the limits in blocks 128 and 132 are not exceeded, the velocity v (block 144) and distance da (block 146) are calculated using the speed reference and deceleration values. Next, a check is performed to see if the speed reference is below the velocity v and to ensure that the distance d to the floor level corresponds to the calculated distance $d_a$ closely enough ($\Delta d=\pm 0.003$ m) and that the flag has been reached. If the conditions are true, a value for the jerk will be calculated from the deceleration reference and speed reference (block 152). After this, a check is made to determine whether the calculated jerk is larger than the pre-selected value $J_{end}$, and if it is, then the calculated jerk will be accepted (blocks 154 and 156). Otherwise the jerk will be assigned a zero value, in other words, the elevator will continue moving with constant deceleration (block 158). The procedure continues again with the calculation of the next speed reference according to FIG. 8.

There are two limit conditions for distances too long or too short, and in addition there are conditions for normal situations for the calculation of a final jerk. Before the limit is checked, the position checkpoint must have been reached. This ensures that the position data is accurate (corrected at the edge of the flag).

In situations where the position data has not been updated, no flag has been detected, although according to the calculated position data it should have been, the position error estimate produces a change in the deceleration $a_{di}$ in advance, which has an effect in the same direction as would result when reaching the flag edge. But as the position error is taken into account in advance, the change is not as large as it would be without estimation.

It is obvious to a person skilled in the art that the embodiments of the invention are not limited to the embodiments described above, but that they can be varied within the scope of the following claims.

What is claimed is:

1. A method for decelerating an elevator car to stop at a landing floor, said method comprising the steps of:

determining position data indicating a position of the elevator car;

determining a deceleration reference value by which the elevator car is decelerated as the elevator car approaches the landing floor;

repeatedly calculating a required deceleration value using the position data; and repeatedly comparing the required deceleration value with the deceleration reference value, and when a difference is detected, changing the deceleration reference value toward the required deceleration valve.

2. The method of claim 1, wherein an actual deceleration of the elevator car is changed at a constant rate, during a final round-off stage, until the actual deceleration becomes zero as the elevator car reaches the landing floor, and wherein the deceleration reference value is changed toward the required deceleration value, during the final round-off stage, in such a way that a speed of the elevator car, the deceleration reference value, and a distance between the elevator car and the landing floor reach zero at substantially the same time.

3. The method of claim 2, wherein the required deceleration value is calculated using a distance value corresponding to a distance required by the final round-off stage.

4. The method of claim 2, wherein the required deceleration value is repeatedly calculated until a starting point of the final round-off stage is reached, and during the final round-off stage, the deceleration reference value is changed at a constant rate, until the deceleration reference value becomes zero as the elevator car reaches the landing floor, without adjusting the deceleration reference value in any other way.

5. The method of claim 3, wherein the required deceleration value is calculated using a speed reference value and a distance remaining between the elevator car and the landing floor.

6. The method of claim 5, wherein the distance remaining between the elevator car and the landing floor is calculated using the distance value corresponding to a distance required by the final round-off stage and an estimated distance error.

7. An apparatus for stopping an elevator car at a landing floor comprising:

a motor for driving the elevator car;

a control device supplying said motor with a controlled electric current;

a tacho-generator connected to said motor and producing an output voltage;

a calculating and regulating unit connected to the output voltage of said tacho-generator, said calculating and regulating unit indirectly determining a velocity of the elevator car and indirectly determining a location of the elevator car;

a position determining device directly determining a position of the elevator car with respect to the landing floor, said position determining device supplying a position signal to said calculating and regulating unit; and a speed reference unit for generating a speed reference value for the elevator car, wherein the calculating and regulating unit reads a distance between the elevator car and the landing floor while the elevator car is moving, wherein the speed reference unit calculates a deceleration reference value for controlling a deceleration of the elevator car, wherein a required deceleration value to allow the elevator car to be driven to the landing floor is repeatedly calculated using the distance between the elevator car and the landing floor, wherein the deceleration reference value is changed towards the required deceleration value until the deceleration reference value corresponds to the required deceleration value, and wherein the speed reference value is determined using the deceleration reference value.

8. The apparatus of claim 7, wherein the location of the elevator car, indirectly determined by said calculating and regulating unit, is changed to the position of the elevator car, directly determined by said position determining device, and wherein the speed reference value is generated in such a way that a speed of the elevator car, the deceleration reference value, and the distance between the elevator car and the landing floor reach zero at substantially the same time.

9. The apparatus of claim 7, wherein when the distance between the elevator car and the landing floor, calculated by the indirectly determined location using said calculating and regulating unit, is substantially equal to the distance between the elevator car and the landing floor, calculated by the directly determined position using said position determining device, the deceleration reference value is unchanged.

10. The apparatus of claim 7, wherein when the distance between the elevator car and the landing floor, calculated by the indirectly determined location using said calculating and regulating unit, is less than the distance between the elevator car and the landing floor, calculated by the directly determined position using said position determining device, the deceleration reference value is set to a lower value.

11. The apparatus of claim 7, wherein when the distance between the elevator car and the landing floor, calculated by the indirectly determined location using said calculating and regulating unit, is greater than the distance between the elevator car and the landing floor, calculated by the directly determined position using said position determining device, the deceleration reference value is set to a higher value, and wherein the deceleration reference value is not set greater than a maximum deceleration value, and is not changed by an amount greater than a maximum deceleration change value.

12. The apparatus of claim 7, further comprising:

a calculating means for calculating a distance value required for a final round-off stage of the elevator car as the deceleration reference value is changing just prior to the elevator car reaching the landing floor; and a distance error generating means for generating a distance error estimate corresponding to an error in the location of the elevator car as indirectly determined by the calculating and regulating unit.

* * * * *